United States Patent [19]

Uneback et al.

[11] Patent Number: 5,047,197

[45] Date of Patent: Sep. 10, 1991

[54] CELLULOSE DERIVATIVE SPINNING SOLUTIONS HAVING IMPROVED PROCESSABILITY AND PROCESS

[75] Inventors: Ingemar Uneback, Odsmal; Lars-Erik Noord; Margreth Strandberg, both of Stenungsund, all of Sweden

[73] Assignee: Berol Kemi AB, Stenungsund, Sweden

[21] Appl. No.: 799,516

[22] Filed: Nov. 19, 1985

[30] Foreign Application Priority Data

Nov. 19, 1984 [SE] Sweden ..... 84058007

[51] Int. Cl.[5] ..... D01F 2/08; D01F 2/24

[52] U.S. Cl. ..... 264/193; 264/187; 264/207; 264/211; 106/163.1; 106/165

[58] Field of Search ..... 264/193, 211, 187, 207; 425/464; 106/163.1, 165

[56] References Cited

U.S. PATENT DOCUMENTS

| | | | |
|---|---|---|---|
| 3,619,223 | 11/1971 | Brower et al. | 264/193 |
| 3,843,378 | 10/1974 | Smith | 264/193 |
| 4,121,012 | 10/1978 | Bockno | 264/193 |
| 4,418,026 | 11/1983 | Blackie et al. | 264/8 |

*Primary Examiner*—Hubert C. Lorin

[57] ABSTRACT

Cellulose derivative spinning solutions are provided, having an improved flow rate at comparable cellulose derivative content and pressure drop across the spinning nozzle, or a higher cellulose derivative content at comparable flow rate, comprising a cellulose derivative in solution in a solvent therefor, and a polyethylene glycol soluble in the solution and having an average molecular weight within the range from about 1.1 to about 4.5 million, in an amount to improve flow rate or increase cellulose derivative content; as well as a process for spinning such solutions through a spinning nozzle at improved flow rate or increased cellulose derivative content.

18 Claims, No Drawings

CELLULOSE DERIVATIVE SPINNING SOLUTIONS HAVING IMPROVED PROCESSABILITY AND PROCESS

Cellulosic spinning solutions contain a cellulose derivative in solution in a solvent therefor. Such solutions are spun under high internal pressure through a spinning nozzle, forming fibers or monofilaments. Various cellulose derivatives are used, but the most commercially important are cellulose acetate and viscose rayon.

Such solutions are known to have a high structural viscosity, but at the high shearing forces under which the solution is forced through a spinning nozzle, the apparent viscosity is reduced to a fraction of the initial viscosity, Gotze, *Chemiefasern,* page 488. However, as a practical matter, spinning solutions containing 10% or more of the cellulose derivative cannot be spun satisfactorily, because of the increase in the apparent viscosity at the nozzle, which deleteriously affects the fiber properties. For example, it is impossible to practice to employ cellulose xanthanate solutions having a cellulose content of 10% or more by weight, if fibers of undiminished strength are desired.

U.S. Pat. No. 4,418,026 suggests that polyethylene glycols having a molecular weight within the range from about 100,000 to about 1,000,000 can be added as solvents to cellulose acetate spinning solutions, thus making it possible to avoid the several purifying stages required after the cellulose acetate has been formed by acetylation, using conventional cellulose acetate solvents. The patent does not indicate that such polyethylene glycols improve the processability of cellulose acetate spinning solutions.

In accordance with the present invention, it has been determined that polyethylene glycols having an average molecular weight within the range from about 1.1 to about 4.5, preferably from about 1.5 to about 4.2, and most preferably from about 2 to about 4, million make it possible to increase the flow rate of a cellulose derivative spinning solution through a spinning nozzle at comparable derivative content and pressure drop across the nozzle, and to increase the cellulose derivative content of the spinning solutions at a comparable flow rate.

Accordingly, the cellulose derivative spinning solutions of the invention having an improved flow rate at comparable cellulose derivative content and pressure drop across the nozzle, and an increased cellulose derivative content at comparable flow rate, comprise (i) a cellulose derivative (ii) in solution in a solvent therefor; and (iii) a polyethylene glycol having an average molecular weight within the range from about 1.1 to about 4.5 million in an amount to improve flow rate or increase cellulose derivative content.

The invention also provides a process for spinning a cellulose derivative spinning solution through a spinning nozzle, which comprises spinning a solution of the cellulose derivative in a solvent therefor in the presence of a polyethylene glycol having an average molecular weight within the range from 1.1 to about 4.5 million, in an amount to improve flow rate at comparable cellulose derivative content and pressure drop across the nozzle or increase cellulose derivative content at comparable flow rate.

The polyethylene glycols in accordance with the invention have a number of ethylene oxide units within the range from about 25,000 to about 100,000.

An improvement in flow rate at constant pressure drop or an increased cellulose derivative content at comparable flow rate is observed in the presence of small amounts of the polyethylene glycol, as little as 0.5 kilogram per ton of cellulose, preferably at least 0.7 kilogram per ton of cellulose. There is no critical upper limit on the amount, but usually amounts in excess of about 10 kilograms per ton of cellulose do not result in a comparably enhanced flow rate of increased cellulose derivative content. Preferably, the amount does not exceed 5 kilograms per ton of cellulose derivative, for economic reasons.

An advantage of an increased cellulose derivative content is an increase in the degree of orientation of the cellulose derivative in the fibers obtained from the spinning solutions, resulting in fibers of higher strength. The invention makes it possible for the first time to spin cellulose derivative spinning solutions having a cellulose derivative content of 10% or more by weight of the solution, with an increased fiber strength as compared to prior spinning solutions having comparable cellulose derivative content.

The invention is applicable to any cellulose derivative that can be dissolved in a spinning solution solvent, including cellulose xanthate, cellulose acetate, cellulose carbamate, cellulose in solution in a tertiary amine oxide, and cuprammonium cellulose.

Any conventional cellulose derivative spinning solution can be used. Cellulose xanthate is for example prepared from carbon disulphide and aqueous sodium hydroxide. The pulp is mercerized with sodium hydroxide, and then xanthated with the carbon disulphide, forming the cellulose xanthate solution. Viscose is an aqueous sodium hydroxide spinning solution of cellulose xanthate.

Other Examples of conventional cellulose derivative spinning solutions are cellulose acetate and cellulose carbamate.

The following Examples in the opinion of the inventors represent preferred embodiments of the invention.

EXAMPLES 1 TO 3

Polyethylene glycol having the average molecular weight shown in Table I below as added to a cellulose xanthate solution in an amount of 1 kilogram per ton of cellulose xanthate. The cellulose xanthate solution was prepared by adding 35% carbon disulphide based on the weight of the cellulose to an aqueous sodium hydroxide solution of the cellulose and contained 10% cellulose xanthate, calculated as pure cellulose, and 5.7% sodium hydroxide. The falling ball viscosity of the solution was 53 seconds. After filtration to remove undesirable particles, the solution was forced through a spinning nozzle at a constant pressure drop across the nozzle of 3 atmospheres gauge pressure. Flow rate was measured, and the following results were obtained:

TABLE I

| Example No. | Polyethylene glycol molecular weight | Increase in % of the flow as compared with the same cellulose xanthate solution without polyethylene glycol |
|---|---|---|
| Control | 800,000 | 7% |
| Example 1 | 2,000,000 | 15% |
| Example 2 | 3,500,000 | 25% |
| Example 3 | 4,800,000 | 2% |

It is apparent from the above results that when the polyethylene glycol has a molecular weight of 2,000,000 to 3,500,000 the flow rate of the cellulose xanthate solution at constant pressure drop was substantially increased, as compared to the same cellulose xanthate solution with polyethylene glycol of lower or higher molecular weight, or, of course, without polyethylene glycol. Fibers spun from the viscose solution containing the polyethylene glycols from Examples 1, 2 and 3 had a fiber strength essentially the same as the corresponding fibers spun from viscose without the polyethylene glycol.

EXAMPLES 4 to 6

Polyethylene glycol (molecular weight 3.5 million) was added to portions of the same cellulose xanthate solution as in Examples 1 to 3, in the amounts shown in Table II below. After filtration, the cellulose xanthate solution was forced through a spinning nozzle at a constant pressure drop of 2 atmospheres gauge pressure. The increase in flow rate was noted, as compared to the same cellulose xanthate solution without polyethylene glycol, with the results shown in Table II.

TABLE II

| Example No. | Amount of polyethylene glycol per ton cellulose (kg) | Increase in % of the flow as compared with the same cellulose xanthate solution without polyethylene glycol |
|---|---|---|
| Example 4 | 0.5 | 4% |
| Example 5 | 1.0 | 16% |
| Example 6 | 2.0 | 21% |

It is apparent from the above results that amounts of polyethylene glycol within the range from 0.5 to 2 kg per ton of cellulose markededly increased flow rate of the cellulose xanthate solution, optimum increases being obtained in amounts within the range from 1 to 2 kilograms of polyethylene glycol per ton of cellulose.

EXAMPLE 7

Cellulose xanthate was prepared from a prehydrolyzed cellulose sulphate pulp having an alpha-cellulose content of 93%. The sulphate pulp was mercerized using 18% aqueous sodium hydroxide solution at 20° C. The alkali cellulose was then xanthalated with 36% carbon disulphide based on the weight of the cellulose. The resulting cellulose xanthate solution contained 11% cellulose xanthate, calculated as pure cellulose, and 6.4% by weight of sodium hydroxide.

Part of the cellulose xanthate solution was mixed with polyethylene glycol having a molecular weight of 3.5 million in an amount of 1 kilogram per ton of cellulose. The remainder did not contain polyethylene glycol. Both cellulose xanthate solutions were tested in respect to filterability, falling ball viscosity, and the rate of flow through a spinning nozzle at a constant pressure drop of 3 atmospheres gauge pressure. The results obtained are shown in Table III.

TABLE III

| | Example 7 With polyethylene glycol | Control Without polyethylene glycol |
|---|---|---|
| Filterability ($k_w$) | 171 | 171 |
| Falling-ball viscosity, seconds | 37 | 36 |
| % increase in flow rate as compared with the Control, cellulose xanthate solution without polyethylene glycol | 41% | — |

It is apparent from the data for Example 7, as compared with the Control, that the flow rate is considerably increased at comparable filterability and falling ball viscosity, when polyethylene glycol is added in accordance with the invention. Also, the fibers display an increased fiber strength.

Having regard to the foregoing disclosure the following is claimed as the inventive and patentable embodiments thereof:

1. A cellulose derivative spinning solution having an improved flow rate at comparable cellulose derivative content and pressure drop across the spinning nozzle, and a higher cellulose derivative content at comparable flow rate, comprising a cellulose derivative in solution in a spinning solution solvent therefor, and a polyethylene glycol having an average molecular weight within the range from about 2 to about 4 million, in an amount to improve flow rate at comparable cellulose derivative content and increase cellulose derivative content at comparable flow rate.

2. A cellulose derivative spinning solution according to claim 1, in which the polyethylene glycol has an average molecular weight of about 35 million.

3. A cellulose derivative spinning solution according to claim 1, in which the cellulose derivative is cellulose acetate.

4. A cellulose derivative spinning solution according to claim 1, in which the cellulose derivative is cellulose xanthate.

5. A cellulose derivative spinning solution according to claim 1, in which the cellulose derivative is cellulose carbamate.

6. A cellulose derivative spinning solution according to claim 1, in which the cellulose derivative is cellulose dissolved in tertiary amine oxide.

7. A cellulose derivative spinning solution according to claim 1, in which the amount of polyethylene glycol is within the range from about 0.5 to about 10 kilograms per ton of cellulose.

8. A cellulose derivative spinning solution according to claim 1, in which the amount of polyethylene glycol is within the range from about 0.7 to about 5 kilograms per ton of cellulose.

9. A cellulose derivative spinning solution according to claim 1, comprising at least 10% by weight of the cellulose derivative.

10. A process for spinning a cellulose derivative into elongated forms through a spinning nozzle, which comprises spinning a cellulose derivative in solution in a cellulose spinning solvent in the presence of added polyethylene glycol having an average molecular weight within the range from about 2 to about 4 million in an amount to improve flow rate of the spinning solution through the spinning nozzle at comparable cellulose derivative content and pressure drop across the nozzle, or an increased cellulose derivative content at a comparable flow rate.

11. A process according to claim 10 in which the molecular weight of the polyethylene glycol is of about 3.5 million.

12. A process according to claim 10 in which the cellulose derivative is cellulose acetate.

13. A process according to claim 10 in which the cellulose derivative is cellulose xanthate.

14. A process according to claim 10 in which the cellulose derivative is cellulose carbamate.

15. A process according to claim 10 in which the cellulose derivative is cellulose dissolved in tertiary amine oxide.

16. A process according to claim 10 in which the amount of polyethylene glycol is within the range from about 0.5 to about 10 kilograms per ton of cellulose.

17. A process according to claim 10 in which the amount of polyethylene glycol is within the range from about 0.7 to about 5 kilograms per ton of cellulose derivative.

18. A process according to claim 10 in which the amount of cellulose derivative is at least 10% by weight.

* * * * *